US010378181B2

(12) United States Patent
Johnson et al.

(10) Patent No.: US 10,378,181 B2
(45) Date of Patent: Aug. 13, 2019

(54) GUARD RAIL WITH INSERT

(71) Applicant: Caterpillar Inc., Peoria, IL (US)

(72) Inventors: Terril James Johnson, Washington, IL (US); Christian D. Ritchie, Morton, IL (US); Gary C. Bryant, Chillicothe, IL (US); Robert J. Madera, Lemont, IL (US)

(73) Assignee: Caterpillar Inc., Deerfield, IL (US)

( * ) Notice: Subject to any disclaimer, the term of this patent is extended or adjusted under 35 U.S.C. 154(b) by 582 days.

(21) Appl. No.: 15/159,558

(22) Filed: May 19, 2016

(65) Prior Publication Data

US 2017/0335543 A1 Nov. 23, 2017

(51) Int. Cl.
*E02F 9/08* (2006.01)

(52) U.S. Cl.
CPC ..... *E02F 9/0833* (2013.01)

(58) Field of Classification Search
CPC ..... E02F 9/0833; E04F 11/18; E04F 11/1842; E04F 11/1844; E04F 2011/1872; E04H 17/14; E04H 17/20; E04H 17/24
See application file for complete search history.

(56) References Cited

U.S. PATENT DOCUMENTS 3,472,489 A 10/1969 Baylin
8,397,869 B2 * 3/2013 Tsutsumi ..... E02F 9/0833 182/127
9,353,504 B2 * 5/2016 Kishinami ..... E02F 9/0833
2004/0060952 A1 * 4/2004 Perlman ..... B43K 23/04 224/269
2009/0095441 A1 * 4/2009 Masunoya ..... E02F 9/00 165/41
2014/0191537 A1 * 7/2014 Bilbruck ..... E02F 9/0833 296/193.07

FOREIGN PATENT DOCUMENTS

JP 2003161018 A 6/2003
JP 2004339924 A 12/2004
JP 2005256294 A 9/2005
JP 2012087545 A 5/2012
JP 5401378 B2 1/2014

OTHER PUBLICATIONS

Richard L. Austin, Robert J. Schultz, Guide to Retroreflection Safety Principles and Retroreflective Measurements, Brochure on the Web, 2009, 50 pages, published by RoadVista, San Diego, CA.

* cited by examiner

*Primary Examiner* — Jonathan P Masinick
(74) *Attorney, Agent, or Firm* — Law Office of Kurt J. Fugman LLC

(57) ABSTRACT

A guard rail system for use with a machine is provided. The guard rail system comprises a handrail member, a support member that defines a longitudinal axis and an open channel that extends along the longitudinal axis and a snap receiving aperture that is in communication with the channel, and an insert that includes a snap feature that is configured to fit within the channel and the snap feature is configured to be disposed in the snap receiving aperture.

18 Claims, 6 Drawing Sheets

GUARD RAIL WITH INSERT

TECHNICAL FIELD

The present disclosure relates to guard rails used with earth moving machinery, construction machinery, and the like. More specifically, the present disclosure relates to guard rails that use structural members that have open configurations.

BACKGROUND

Traditional guard rails that are used on earth moving machinery, construction machinery and the like typically use structural members that have closed configurations such as circular shaped tubes. However, these structural members may be more expensive than desirable. As a result, many customers request lower cost guard rails.

One way to provide guard rails at a lower cost involves providing structural members that have an open configuration. For example, the vertical structural members that extend upwardly from the platform of machinery may have an open configuration that provides a channel or opening along its vertical length. This may create a potential snag or pinch point.

SUMMARY OF THE DISCLOSURE

An insert for use with a support member of a guard rail system is provided. The insert may comprise a main wall portion that defines a longitudinal axis, a first end and a second end disposed along the longitudinal axis, a first edge and a second edge that extend generally along the longitudinal axis from the first end to the second end, and a tail portion that extends from the main wall portion and forms an included angle with the main wall portion that is less than 180°. At least one sidewall portion extends from an edge of the main wall portion and forms a first snap feature that points outwardly from the sidewall portion.

A guard rail system for use with a machine is provided. The guard rail system comprises a handrail member, a support member that defines a longitudinal axis and an open channel that extends along the longitudinal axis and a snap receiving aperture that is in communication with the channel, and an insert that includes a snap feature that is configured to fit within the channel and the snap feature is configured to be disposed in the snap receiving aperture.

DETAILED DESCRIPTION

Figure 1:
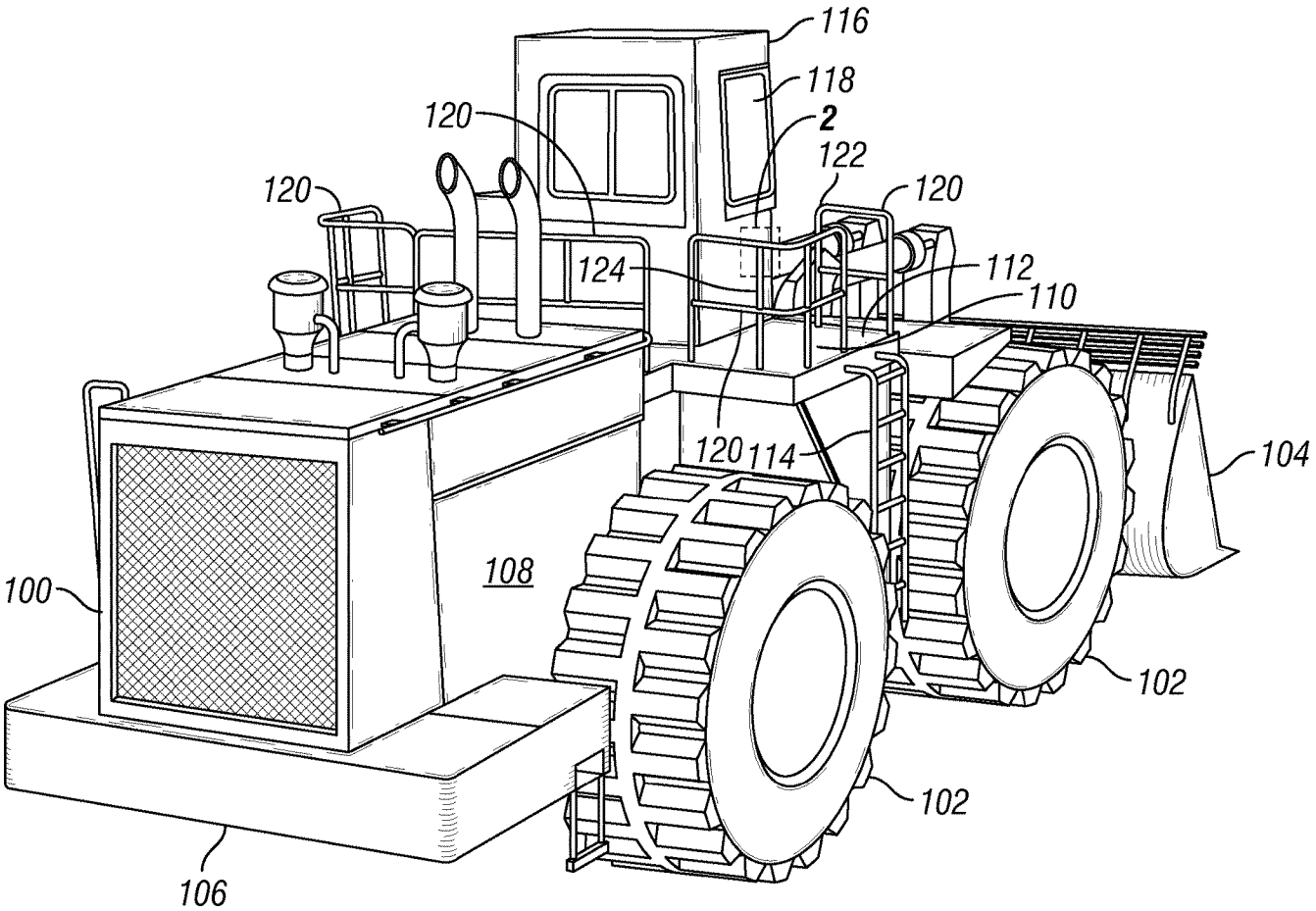
FIG. 1 is a perspective view of a machine that may use a guard rail system according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

This concept provides a filler piece or insert that is configured to prevent items from catching in the channel of the vertical guard rail support. In some embodiments, the insert may have a reflective aspect added to it. This provides a higher visibility to the machine with the new guard rail system. This feature may be added at no extra cost. The insert may also have integrated support and attachment features. This provides a method of assembling the guard rail system without the need of fasteners and the like.

Looking at FIG. 1, a front loader 100 is shown as an exemplary machine that may use various embodiments of the present disclosure. The front loader 100 includes tires 102 that support the machine 100 and a bucket 104 for moving material such as dirt, rocks, etc. as is known in the art. The front loader 100 includes a rear bumper 106 and an engine hood 108 that conceals the engine and a portion of the drive for the machine 100.

A platform 110 is also provided that has a substantially flat top 112 that allows the operator to walk on the top 112 of the machine 100 when mounting or dismounting the machine 100 using the ladder 114. A cab 116 is also provided that includes a plurality of windows 118 and controls, operator's seat, etc. that are disposed inside the cab 116.

As is well known and understood, movement around the operator's platform 112 is required, initially for the operator to get from the ladder 114 into the operator's cab 116, and later for maintenance. A guard rail system 120 is provided to help the operator or other personnel from falling off the machine. The guard rail system 120 may comprise a plurality of subassemblies. One such assembly is provided and depicted by the area designated by rectangle 2 in FIG. 1 that may use a handrail 122, insert (best seen in FIGS. 2 thru 7) and a vertical support member 124 as will now be described with reference to FIGS. 2 thru 7. It is to be understood that the embodiments discussed herein may be varied both in configuration and application compared to anything shown in the figures. For example, they may be used on any machine or stationary structure and their dimensions and configurations may be altered as needed or desired.

Figure 2:
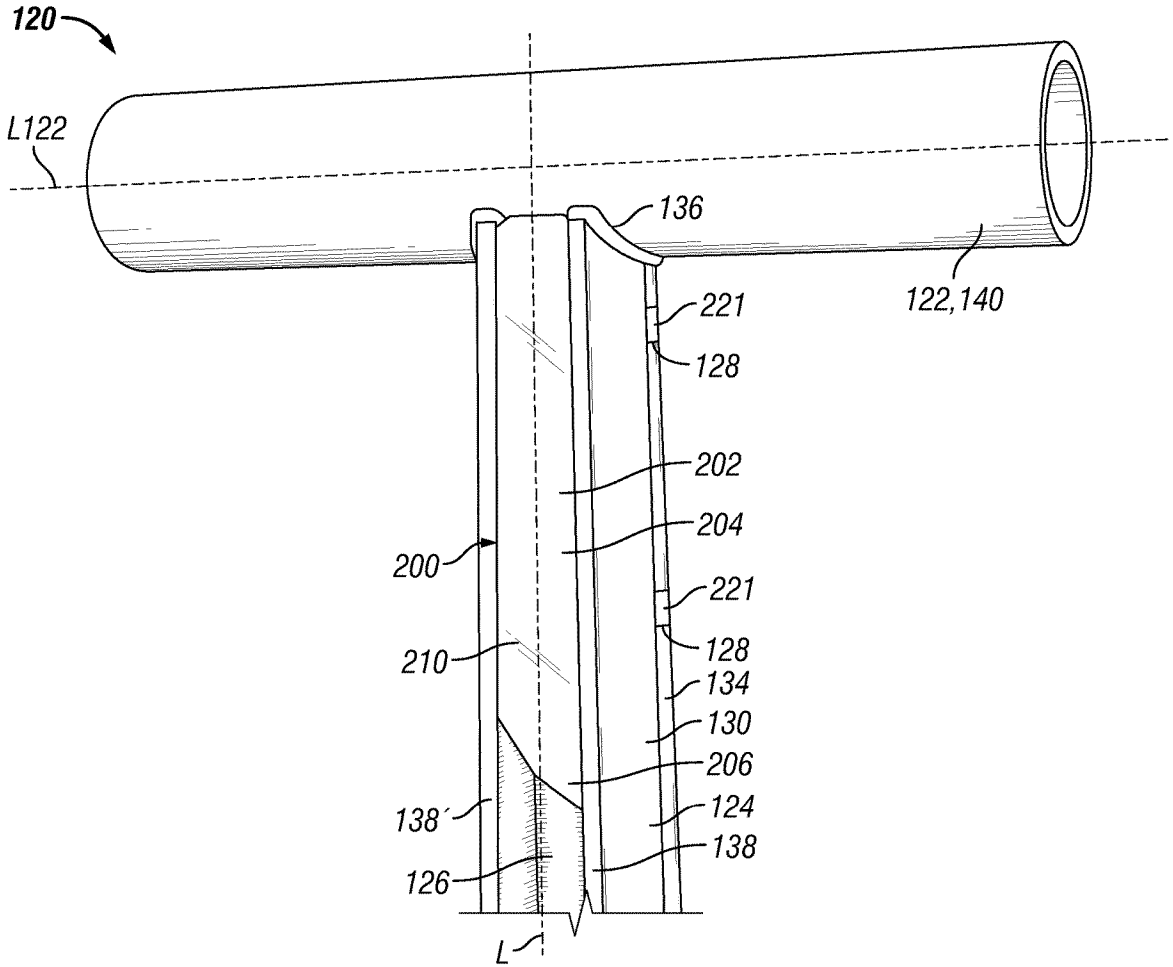
FIG. 2 is an enlarged fragmentary detail view of a portion of the guard rail system of FIG. 1 showing an open configured vertical structural member and an insert installed into the channel of the vertical structural member.
Figure 4:
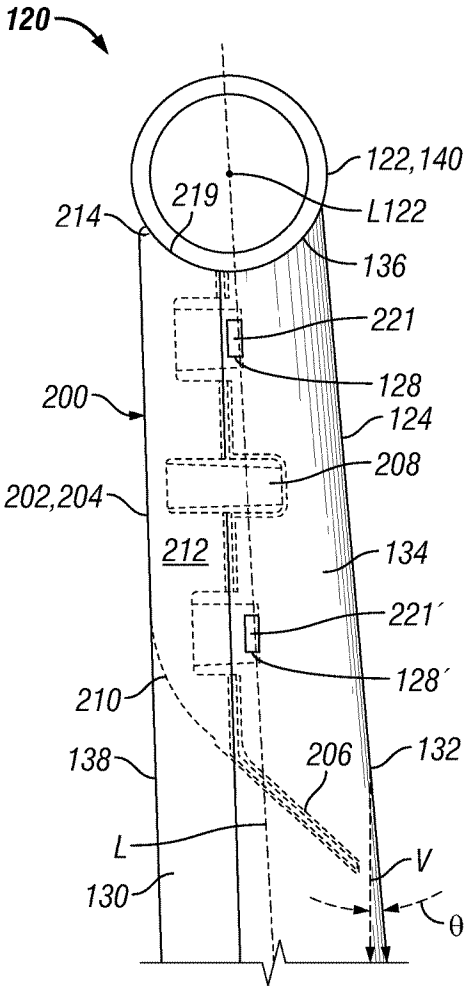
FIG. 4 is a side view of the guard rail of FIG. 3 with hidden features of the insert shown in phantom lines.
Figure 3:
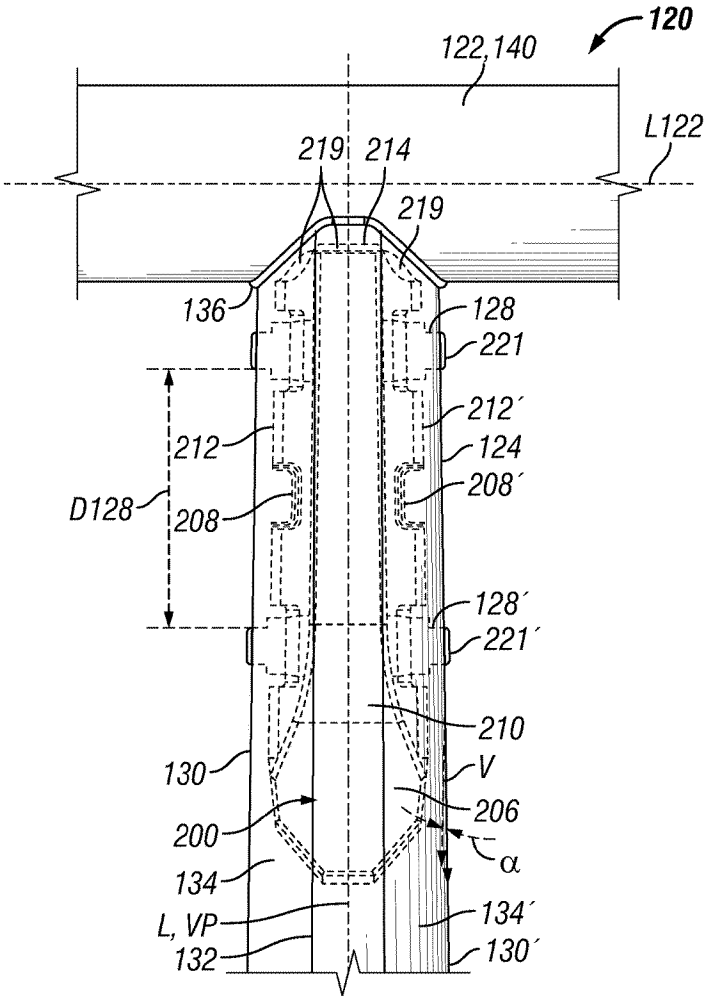
FIG. 3 is a rear view of the guard rail system of FIG. 2 with hidden features of the insert shown in phantom lines.

Referring now to FIGS. 2 thru 4, the guard rail system 120 may be more clearly seen. The guard rail system 120 shown comprises a handrail member 122, a support member 124 that defines a longitudinal axis L and an open channel 126 that extends along the longitudinal axis L and a snap receiving aperture 128 that is in communication with the channel 126, and an insert 200 that includes a snap feature 221 that is configured to fit within the channel 126 and the snap feature 221 is disposed in the snap receiving aperture 128.

For this particular embodiment, the support member 124 includes a generally u-shaped or c-shaped configuration that includes a pair of sidewalls 130, a rear wall 132 and transition walls 134 that connect the sidewalls to the rear wall 132. In some embodiments, the transitional walls 134 may be straight walls or curved, e.g. radiused walls. In other embodiments, the sidewalls 130 may be connected to each other by a continuously curved wall such as a wall that approximates the shape of a semi-circle, etc. As can be best seen in FIGS. 3 and 4, the rear wall 132 flares out at an angle Θ such as 5° (see FIG. 4) from a purely vertical direction V while the sidewalls 130 flare out at an angle αof 1-2° (see FIG. 3) from a purely vertical direction V. The angles allow the base of the vertical support member 124, where extra rigidity is desired, to be wider than the top portion of the support member 124, where reflective features may be provided to allow for better visibility of the machine 100. It is contemplated that the configuration of the vertical support member may be adjusted as needed or desired. The support member may be attached to another structural member, such as the handrail, or the platform via welding, fastening, etc.

Furthermore, while the vertical support member is obviously oriented vertically, it is contemplated that the orientation of the support member 124, handrail 122 and insert 200 may be altered as needed or desired.

As shown in FIGS. 2 thru 4, the support member 124 includes a first end or upper end 136 that is positioned along the longitudinal axis L and the snap receiving aperture 128 is positioned proximate the first end 136. Furthermore, the first snap receiving aperture 128 is positioned on a sidewall 130. The support member 124 further defines a second snap receiving aperture 128' that is positioned a predetermined distance D128 (see FIG. 3) away from the first snap receiving aperture 128 along the longitudinal axis L. A second snap feature 221' of the insert 200 is disposed in the second snap receiving aperture 128'. The snap features and the snap apertures are shown to be rectangular but they may be varied to be circular or any other needed or desired configuration. In other embodiments, the snap feature may be located on the transition wall.

As best seen in FIG. 2, the sidewalls 130 define front surfaces 138 and the insert 200 includes a main wall portion 202 that defines a front surface 204 that is flush to recessed compared to the front surfaces 138 of the sidewalls 130 of the support member 124. As best seen in FIG. 4, the insert 200 further includes a tail portion 206 that extends from the main wall portion 202 of the insert 200 toward the rear wall 132 of the support member 124. A blend 210 is provided to make the transition from the main wall portion 202 to the tail portion 206 more aesthetically pleasing. The insert 200 also includes a support portion 208 that is configured to contact the transition wall 134 of the support member 124. The support portion 208 may extend from a sidewall 212 of the insert 200 as shown in FIGS. 3 and 4 or it may extend from another portion of the insert 200 such as its main wall portion 202.

Looking at the handrail 122 in FIGS. 2 thru 4, it can be seen that it includes a circular perimeter 140 and at least a portion of insert 200 is configured to match the circular perimeter 140. More particularly as best seen in FIGS. 3 and 4, at the top end 214 of the main wall portion 202 of the insert 200, the insert 200 is configured with a complimentary shaped profile 219 hat may or may not continue onto a sidewall 212 of the insert 200 as will be discussed in more detail momentarily. The handrail 122 is made from circularly annular shaped tubing but other configurations are possible.

For the guard rail system 120 depicted in FIGS. 2 thru 4, it can be seen that the insert 200, handrail 122, and vertical support member 124 are symmetrical about a vertical plane VP (see FIG. 3) that extends through the longitudinal axis L of vertical support member 124. This may not be the case for other embodiments of the present disclosure.

Figure 5:
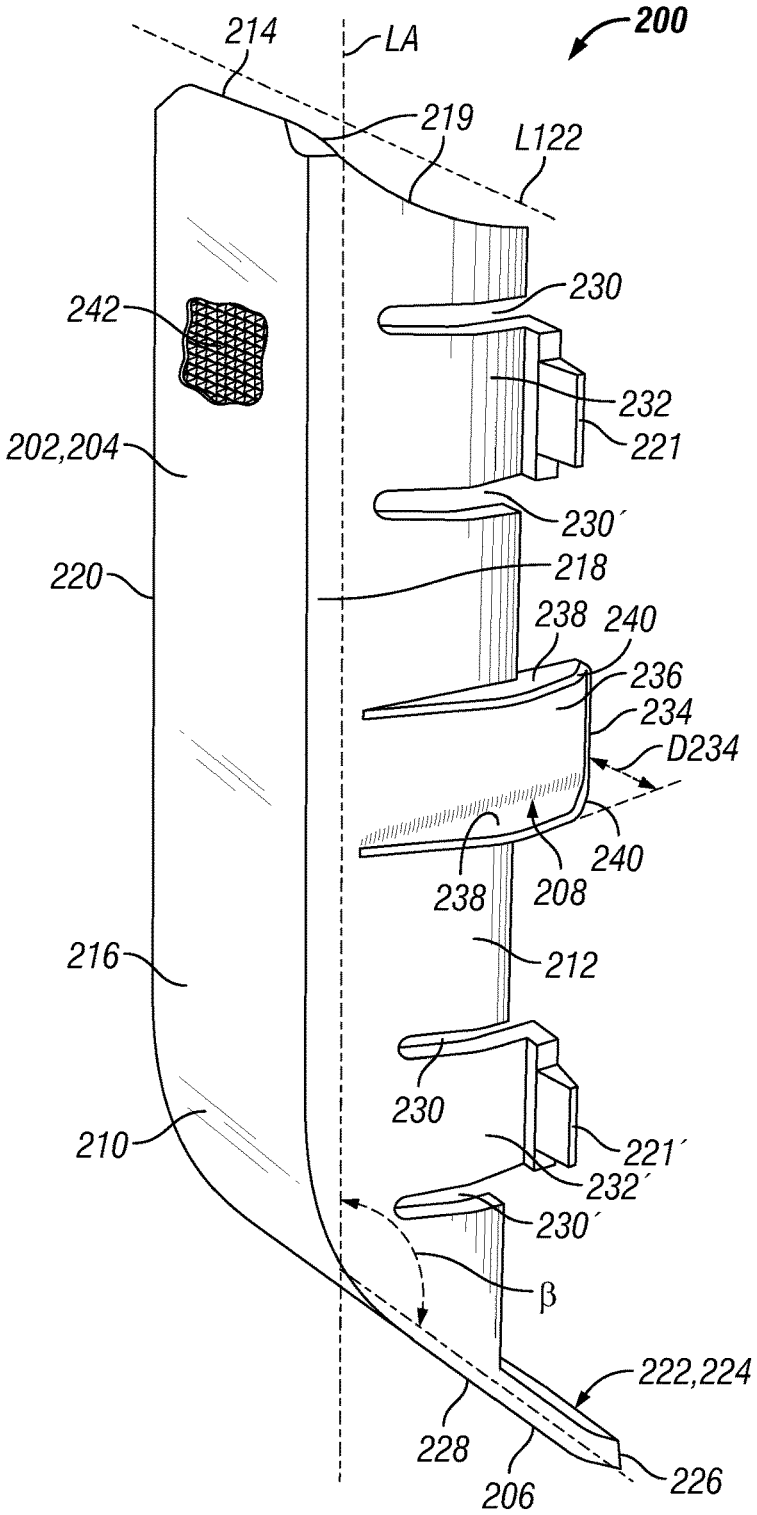
FIG. 5 is a front perspective view of the insert of FIG. 2.
Figure 6:
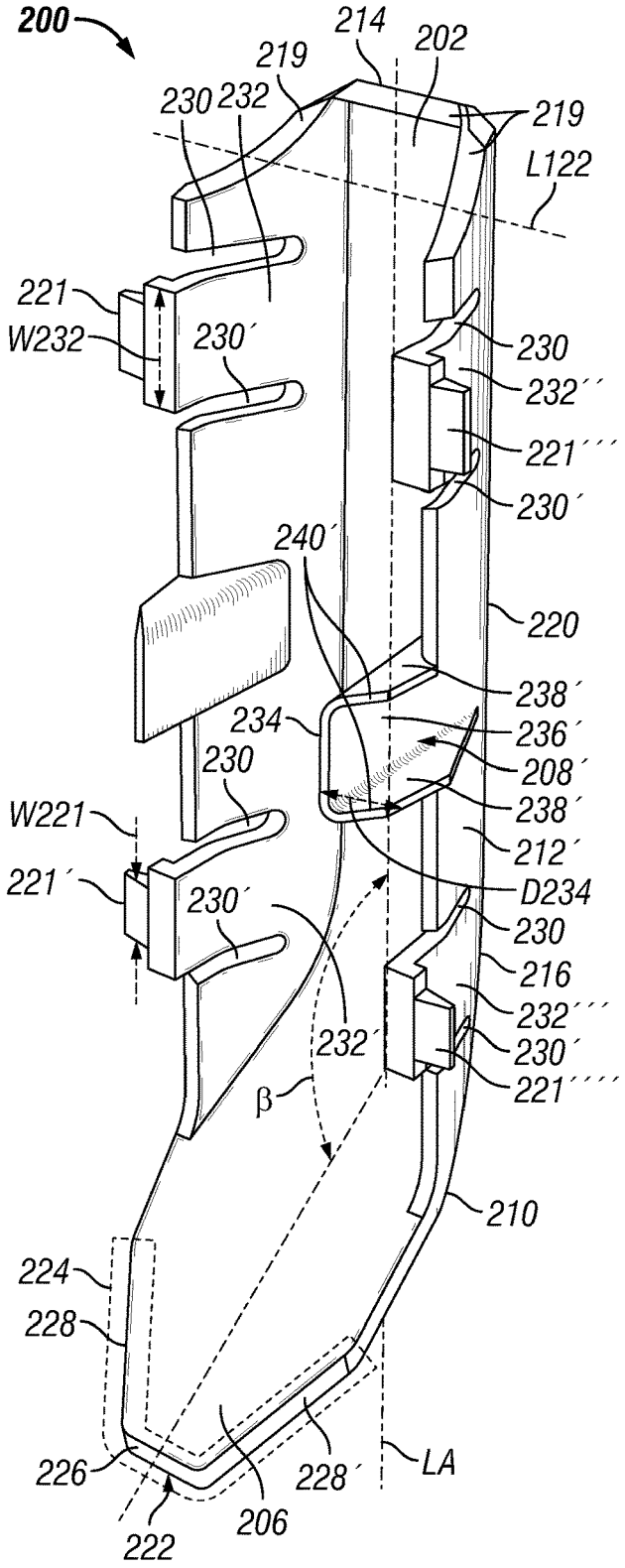
FIG. 6 is a rear perspective view of the insert of FIG. 2.

Focusing now on FIGS. 5 and 6, the details of the insert 200 may be more clearly seen as the insert 200 is shown in isolation from the vertical support member 124 of guard rail system 120. The insert 200 comprises a main wall portion 202 that defines a longitudinal axis LA, a first end 214 and a second end 216 disposed along the longitudinal axis LA, a first edge 218 and a second edge 220 that extend generally along the longitudinal axis LA from the first end 214 to the second end 216, a tail portion 206 that extends from the main wall portion 202 proximate the second end 216 and forms an included angle β with the main wall portion 202 that is less than 180°, and at least one sidewall portion 212 that extends from an edge 218, 220 of the main wall portion 202 and that forms a first snap feature 222 that points outwardly from the sidewall portion 212. For this embodiment, the angle β may be approximately 135° but this may be varied as desired. The blend portion 210 provides a transition from the main wall portion 202 to the tail portion 206.

As used herein, the term "generally" with reference to angles or directions means that a feature or angle is 0°-5° range of a reference direction or feature knowing that such deviations are routine for a number of reasons including manufacturing tolerances, draft angles, flare angles, etc. Also, the term "outwardly" means in a direction that is away from the interior of the channel 126 of a support member 124 or its longitudinal axis L or the longitudinal axis LA of the insert 200 while the term "inwardly" means in a direction that is toward the interior of the channel 126 of a support member 124 or its longitudinal axis L or the longitudinal axis LA of the insert 200.

Referring back to FIGS. 5 and 6, the first end 214 of the main wall portion 202 defines an arcuate profile 219 that extends in a direction L122 that is perpendicular to the longitudinal axis LA of the main wall portion. This direction is generally the same as the longitudinal axis L122 of the handrail 122 shown in FIGS. 2 thru 4.

As best seen in FIG. 6, the tail portion 206 defines a free end 222 that includes a contoured profile 224. The profile 224 is shaped so as to match the inside contour of the channel 126 of the support member 124 (see FIG. 2) where its sidewall 130 meets a transition wall 134 and where the transitional wall 134 meets the rear wall 132. As a result, the insert 200 may be fully inserted into the channel 126 until it is snapped into place and the tail portion 206 is supported by the support member 124. For this embodiment, the contoured profile 224 includes a straight end surface 226 and chamfered surfaces 228 positioned on either side of the straight end surface 226.

Looking at both FIGS. 5 and 6, the sidewall portion 212 defines a pair of slots 230 that define a snap finger 232 and the snap feature 221 extends from the snap finger 232. Two similarly configured snap fingers 232 and snap features 221 are provided on the same sidewall 212. As shown in FIG. 6, the width W221 of the snap features 221 along a direction that is generally parallel to the longitudinal direction LA is less than the width W232 of the snap fingers 232 along the same direction. These widths may be varied as needed or desired and may in some cases may have the same value.

The insert 200 further includes a support portion 208 that includes a contact surface 234 that is spaced inwardly away from the sidewall portion 212 a predetermined distance D234 along a direction L122 that is generally perpendicular to the longitudinal axis LA. The support portion 208 includes a generally c-shaped or u-shaped configuration that is formed by a back wall 236 that runs generally parallel to the longitudinal axis LA and ribs 238 that extend from the sidewall 212 to the rear wall in a direction L122 generally perpendicular to the longitudinal axis LA. The free end of the support feature 208 includes chamfered surfaces 240 adjacent either sides of the contact surface 234. The contact surface 234 and chamfered surfaces 240 are configured to match the contour of the inner surface of the transitional wall 134 of the support member 124 (see FIGS. 3 and 4).

The support portion 208 provides support to the insert 200 once it is snapped into place so that the insert 200 will not buckle inwardly if pressed upon in a direction that is parallel to the direction of assembly 302 as will be discussed momentarily. The support portion 208 is disposed between the first and second snap features 221, 221' along a direction that is generally parallel to the longitudinal axis LA.

For the embodiment of the insert shown in FIGS. 5 and 6, the arcuate profile 219 extends through a sidewall portion 212 along a direction L122 that is generally perpendicular to the longitudinal axis LA. The arcuate profile 219 also passes through an end 214 of the main wall 202 of the insert 200. The arcuate profile may be omitted for either the sidewall portion or the end of the main wall of the insert in other embodiments.

For the embodiment shown in FIG. 5, the insert 200 comprises a translucent plastic material that has reflective properties. For example, reflective dimples or other surface features 242 such as used on bicycle or road reflectors may be found on the interior surface of the main wall 202 of the insert 200. The insert may be made from a polycarbonate material that is translucent and that has the durability and strength needed for a particular application. The insert 200 of FIG. 6 may be made from another plastic material that is opaque and that lacks any reflective properties. In other embodiments, reflective properties may be imparted to the insert by the application of a reflective coating or sticker, etc. The insert 200 is symmetrical about a vertical plane VP (see FIG. 3) but this may not be the case for other embodiments.

INDUSTRIAL APPLICABILITY

In practice, a machine 100 may be sold or retrofitted with any of the embodiments of a guard rail system 120 or insert 200, 300 as described herein.

The various embodiments of the apparatus described herein may be manufactured and assembled as will now be described. The support member 124 may be made using a stamping or forming process that creates the snap receiving apertures 128 in a piece of sheet metal and then bends the sheet metal into the desired shape. The handrail 122 may be made from tube stock and the insert 200, 300 may be made using a plastic injection molding process.

Figure 7:
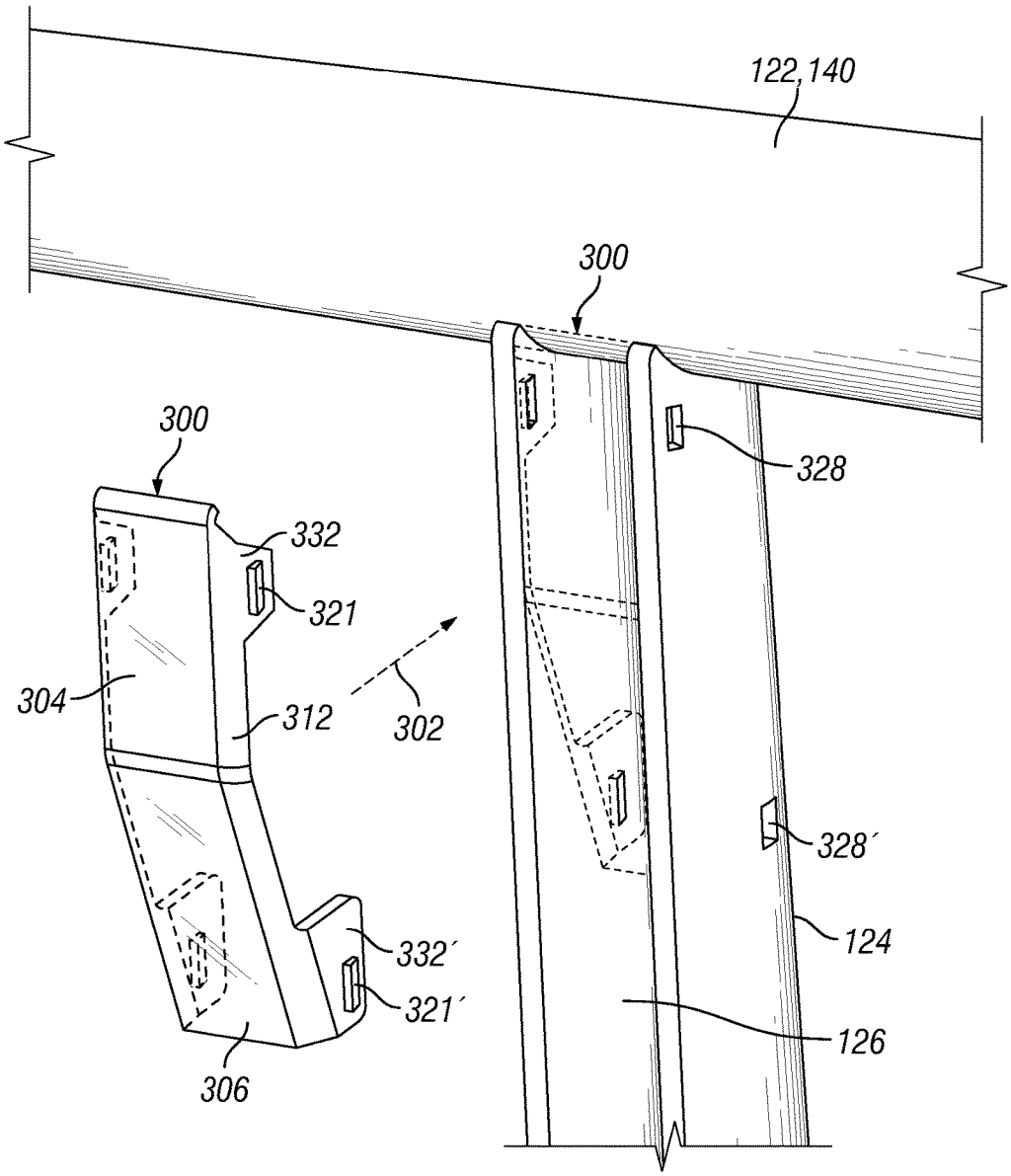
FIG. 7 is an exploded assembly view of a guard rail system similar to that of FIG. 2.

FIG. 7 illustrates yet another guard rail system 120' similar to that shown in FIGS. 2 thru 4 that uses another insert 300 that is similar to the insert 200 of FIGS. 5 and 6. For this embodiment of the insert 300, the snap feature 321 is located on a snap finger 332 that is formed by a projection that extends from the sidewall 312 of the insert 300, eliminating the need for providing slots to create snap fingers such as shown in FIGS. 5 and 6. The position of the snap features 321 are not aligned horizontally as is the case for the insert in FIGS. 5 and 6. Also, the free end of the tail portion 306 lacks a contoured profile as compared to the insert of FIGS. 5 and 6. A support portion is also omitted and the angle formed by the tail portion 306 with respect to the main wall portion 304 is greater than the 135° angle used with the embodiment shown in FIGS. 5 and 6.

As may be understood by looking at FIGS. 2 and 7, any insert 200, 300 may be assembled into the support member 124, 124' by moving the insert 200, 300 along a horizontal direction 302 until its snap features 221, 321 engage the edges of the snap apertures 128, 328, locking the insert into place. At approximately the same time, the upper end 214, 314 of the insert 200, 300 contacts the circular profile 140 of the handrail 122. The guard rail system 120 of FIGS. 2 thru 4 is assembled much the same way as FIG. 7 except that the tail portion 206 and the support portion 208 of the insert 200 of FIGS. 2 thru 4 will contact or nearly contact the support member 124 as the insert is snapped into place.

With reference to FIGS. 1 and 7, the reflective properties of the insert may be such that light is reflected from the insert is in an outward horizontal direction away from the platform 110 of the machine 100. This direction is essentially in the opposite direction as the assembly direction 302. It is further contemplated that the reflective properties of the insert may be altered depending on the need or application.

More specifically, the use of rectroflectivity may be employed to improve the visibility of machines to others at nighttime. Retroreflectivity is an optical phenomenon where light rays are reflected in a direction that is substantially parallel and opposite to the direction that they hit a retroreflector. This may occur at angles other than purely a horizontal direction, allowing a machine to be visible to sources of light at various positions around the machine. Examples of retroreflectors that might be used include cube corners and microspheres of glass or plastic, etc.

The effectiveness of the use of retroreflectivity for an insert may be expressed in terms of the coefficient of retroreflection, $R_A$. This may be measured per ASTM Standard E808-91. $R_A$ is defined as the coefficient of luminous intensity, $R_I$, of a plane retroreflecting surface to its area. The metric unit for $R_A$ is candelas per lux per square meter (cd/lx/m$^2$). $R_I$ is the ratio of the luminous intensity of the retroreflector in the direction of observance, E, to the illuminance at the retroreflector on a plane perpendicular to the direction of the incident light.

The insert may have a $R_A$ value that ranges from 7 to 250 or more cd/lx/m$^2$. When yellow on a black background is used, it is contemplated that the $R_A$ may range from 50 to 75 cd/lx/m$^2$.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An insert for use with a support member of a guard rail system, the insert comprising:

a main wall portion that defines a longitudinal axis, a first end and a second end disposed along the longitudinal axis, a first edge and a second edge that extend generally along the longitudinal axis from the first end to the second end;

a tail portion that extends from the main wall portion and forms an included angle with the main wall portion that is less than 180°; and at least one sidewall portion that extends from an edge of the main wall portion and that forms a first snap feature that points outwardly from the sidewall portion.

2. The insert of claim 1, wherein the first end of the main wall portion defines an arcuate profile that extends in a direction that is generally perpendicular to the longitudinal axis of the main wall portion.

3. The insert of claim 2, wherein the arcuate profile extends through a sidewall portion along a direction that is generally perpendicular to the longitudinal axis.

4. The insert of claim 1, wherein the tail portion defines a free end that includes a contoured profile.

5. The insert of claim 4, wherein the contoured profile includes a straight end surface and chamfered surfaces positioned on either side of the straight end surface.

6. The insert of claim 1, wherein the sidewall portion defines a pair of slots that define a snap finger and the snap feature extends from the snap finger.

7. The insert of claim 1 further comprising a support portion that includes a contact surface that is spaced inwardly away from the sidewall portion a predetermined distance along a direction that is generally perpendicular to the longitudinal axis.

8. The insert of claim 7, wherein the support portion includes a generally c-shaped or u-shaped configuration.

9. The insert of claim 7 further comprising a second snap feature that extends from the same sidewall as the first snap feature and the support portion is disposed between the first and second snap features along a direction that is generally parallel to the longitudinal axis.

10. The insert of claim 1, wherein the insert comprises a translucent plastic material that has reflective properties that define a coefficient of retroreflection that ranges from 7 to 250 cd/lx/m2.

11. A guard rail system comprising:

a handrail member that includes a circular perimeter;

a support member that defines a longitudinal axis and an open channel that extends along the longitudinal axis and a snap receiving aperture that is in communication with the channel; and an insert that includes a snap feature that is configured to fit within the channel and the snap feature is configured to be disposed in the snap receiving aperture and at least a portion of the insert is configured to match the circular perimeter of the handrail member;

wherein the support member includes a first end that is positioned along the longitudinal axis and the snap receiving aperture is positioned proximate the first end.

12. The guard rail system of claim 11, wherein the support member includes a generally u-shaped or c-shaped configuration that includes a pair of sidewalls, a rear wall and a pair of transition walls that connect the sidewalls to the rear wall.

13. The guard rail system of claim 11, wherein the support member is vertically oriented.

14. The guard rail system of claim 11, wherein the support member includes a pair of sidewalls and a pair of transition walls and the snap receiving aperture is positioned on a sidewall or a transition wall.

15. The guard rail system of claim 11, wherein the support member includes a pair of sidewalls that define front surfaces and the insert includes a main wall portion that defines a front surface that is flush to recessed compared to the front surfaces of the sidewalls of the support member.

16. The guard rail system of claim 15, wherein the support member includes a rear wall and the insert further includes a tail portion that extends from the main wall portion of the insert toward the rear wall of the support member.

17. The guard rail system of claim 15, wherein the insert includes a support portion that is configured to contact the support member.

18. The guard rail system of claim 11, wherein the support member further defines a second snap receiving aperture that is positioned a predetermined distance away from the first snap receiving aperture along a direction that generally parallel to the longitudinal axis.

* * * * *